US012710199B2

(12) United States Patent
Wan et al.

(10) Patent No.: US 12,710,199 B2
(45) Date of Patent: Aug. 18, 2026

(54) INTEGRATED FORKLIFT RECEPTACLE IN AN HVACR UNIT AND A METHOD OF TRANSPORTING AN HVACR UNIT WITH AN INTEGRATED FORKLIFT RECEPTACLE

(71) Applicants: TRANE AIR CONDITIONING SYSTEMS (CHINA) CO., LTD., Taicang (CN); TRANE INTERNATIONAL INC., Davidson, NC (US)

(72) Inventors: Wang Shu Wan, Taicang (CN); Ning Sun, Taicang (CN); Min Wang, Taicang (CN)

(73) Assignees: TRANE AIR CONDITIONING SYSTEMS (CHINA) CO., LTD., Taicang (CN); TRANE INTERNATIONAL INC., Davidson, NC (US)

( * ) Notice: Subject to any disclaimer, the term of this patent is extended or adjusted under 35 U.S.C. 154(b) by 0 days.

(21) Appl. No.: 18/677,197

(22) Filed: May 29, 2024

(65) Prior Publication Data

US 2024/0401842 A1 Dec. 5, 2024

(30) Foreign Application Priority Data

May 31, 2023 (CN) ..... 202321366744.6

(51) Int. Cl.
*F24F 13/32* (2006.01)

(52) U.S. Cl.
CPC ..... *F24F 13/32* (2013.01)

(58) Field of Classification Search
CPC ..... F24F 13/32; F24F 13/04; F25B 1/00
See application file for complete search history.

(56) References Cited

U.S. PATENT DOCUMENTS 5,791,150 A 8/1998 Bosher et al.
6,095,482 A * 8/2000 LaGrotta ..... H02B 1/50 108/51.11

(Continued)

FOREIGN PATENT DOCUMENTS

CN 101592364 A 12/2009
CN 214846589 U 11/2021

(Continued)

*Primary Examiner* — Frantz F Jules
*Assistant Examiner* — Emmanuel E Duke
(74) *Attorney, Agent, or Firm* — HSML P.C.

(57) ABSTRACT

An HVACR unit is disclosed. The HVACR unit includes a circuit having a compressor, a first heat exchanger, a second heat exchanger, and an expander. A heat exchanger assembly includes a fan and one of the first heat exchanger and the second heat exchanger, the fan being configured to draw air through the heat exchanger assembly for exchanging thermal energy with a working fluid in the circuit. The frame includes a unit support disposed on a base, the unit support being configured to laterally support the heat exchanger assembly, and the base being configured to vertically support the heat exchanger assembly. A forklift receptacle disposed in the HVACR unit, including one or more channels configured to respectively receive one or more tines of a forklift. The forklift receptacle is overlapped, in a longitudinal direction of the HVACR unit, with a center of mass of the HVACR unit.

16 Claims, 11 Drawing Sheets

(56) References Cited

U.S. PATENT DOCUMENTS

| | | | | |
|---|---|---|---|---|
| 2003/0091417 | A1* | 5/2003 | Swann | B62B 5/0083 414/458 |
| 2014/0103548 | A1* | 4/2014 | Senaydin | B65D 81/263 261/31 |
| 2019/0195515 | A1* | 6/2019 | Ruhlander | F24F 1/10 |
| 2021/0325082 | A1* | 10/2021 | Chothave | F24F 13/30 |

FOREIGN PATENT DOCUMENTS

| | | | | |
|---|---|---|---|---|
| EP | 3364129 | A1 * | 8/2018 | F25B 6/02 |
| WO | WO-2017138132 | A1 * | 8/2017 | F24F 1/60 |
| WO | WO-2020113152 | A2 * | 6/2020 | F04C 29/02 |

* cited by examiner

INTEGRATED FORKLIFT RECEPTACLE IN AN HVACR UNIT AND A METHOD OF TRANSPORTING AN HVACR UNIT WITH AN INTEGRATED FORKLIFT RECEPTACLE

FIELD

This disclosure relates generally to a heating, ventilation, air conditioning, and refrigeration (HVACR) unit. More specifically, the disclosure relates to a forklift receptacle integrated into the HVACR unit for loading and unloading the HVACR unit from a transporting vehicle.

BACKGROUND

An HVACR unit can include a circuit having a compressor, a condenser, an expander, and an evaporator. At the HVACR unit manufacturer, the assembled HVACR unit can be placed on the floor of a warehouse spaces. The HVACR unit can be loaded onto a truck, transported to the site of the user, and unloaded to be installed.

SUMMARY

This disclosure relates generally to a heating, ventilation, air conditioning, and refrigeration (HVACR) unit. More specifically, the disclosure relates to a forklift receptacle integrated into the HVACR unit for loading and unloading the HVACR unit from a transporting vehicle.

The HVACR unit can be arranged to be frequently transported between the manufacturer and one or more users, e.g., in an HVACR rental service. HVACR units can loaded and unloaded into a transporting vehicle by any lifting equipment such as a forklift, a crane, or the like. Forklifts are generally more available in industrial setting and more suitable for being transported with the HVACR unit than a crane system.

The transporting vehicle can be a flatbed truck having a bed or deck integrated to the truck or included in a detachable trailer of the truck. The bed or deck of a flatbed truck can be configured to transport cargo. Under current Department of Transportation (DOT) regulations, maximum cargo dimensions allowable on a flatbed truck is 24 feet (length) by 102 inches (width) by 102 inches (height), or 7315.2 millimeters (mm) (length) by 2590.8 mm (width) by 2590.8 mm (height). A stepped bed truck, having a bed or a section of the bed closer to the ground, can transport cargo that is taller than 102 inches. However, a stepped bed truck is less available than flatbed trucks such that the logistic efficiency of transporting cargo can be lower and costs can be higher.

Some HVACR unit designs have a height of 2500 mm, marginally smaller than the maximum allowable height of 2590.8 mm. The length of such HVACR units can be at or above 5813 mm, or 7155 mm. Such HVACR units can have capacity of at or above 120, 140, 160, 180, or 200 tons (nominal), characterized, e.g., by its compressor capacity. Such HVACR units can have a weight of at least 10,000 lbs., 12,000 lbs., 14,000 lbs., 15,000 lbs., 17,000 lbs., or more.

Standard pallets have a height of 6.5 inches (about 165.1 mm), and a minimum height of the opening for receiving a tine of a forklift is 127 mm. With an HVACR unit generally having a height of about 2500 mm, when stacked on a pallet, the overall height can exceed the height limit of 2590.8 mm allowable by DOT. By integrating the forklift receptacle into the frame of an HVACR unit, the overall height of the HVACR unit and forklift receptacle can be within DOT requirement and suitable for being transported on flatbed trucks.

HVACR units are generally designed to be rested on a support surface, e.g., on the roof, the ground, the bed of a truck, a pallet, or the like. A bottom frame member of HVACR units are configured to evenly transfer weight to the support surface. A plurality of lifting plates or crane lugs can be located evenly across the HVAVR unit for lifting or hoisting the HVACR unit with a crane. When lifted by a forklift, the HVACR unit should support its weight at the forklift receptacle through corresponding lateral supporting structures, for controlling deflection on the base member due to the weight of the components of the HVACR units. The forklift receptacle is generally narrower than the spacing of the lifting plates or crane lugs, such that the weight on the end of the HVACR unit can cause more deflection to the HVACR unit.

The forklift receptacle can include one or more openings for receiving tines of a forklift. A distance between the centers of a first opening and a center of a second opening for receiving tines of a forklift ("a center-to-center distance") can be between 54 inches and 60 inches, or 1371.6 mm to 1524 mm. In an embodiment, each of the openings for receiving one of the tines of a forklift is at least 4 inches (tall) by 10 inches (wide), or 127 by 245 mm. The forklift receptacle is configured be overlapped, in the longitudinal direction of the HVACR unit, with a center of mass of the HVACR unit for stability in transport by forklifts. In an embodiment, the forklift receptacle is configured to have a midpoint overlapping with the center of mass of the HVACR unit for stability in transport by forklifts.

In an embodiment, an HVACR unit is disclosed. The HVACR unit includes a circuit that includes a compressor, a first heat exchanger, a second heat exchanger, and an expander. A heat exchanger assembly includes a fan and one of the first heat exchanger and the second heat exchanger, the fan being configured to draw air through the heat exchanger assembly for exchanging thermal energy with a working fluid in the circuit. A frame includes a unit support disposed on a base, the unit support being configured to laterally support the heat exchanger assembly, and the base being configured to vertically support the heat exchanger assembly. A forklift receptacle is disposed in the HVACR unit. The forklift receptacle includes one or more channels configured to respectively receive one or more tines of a forklift for lifting the HVACR unit, and the forklift receptacle overlaps with a center of mass of the HVACR unit in a longitudinal direction of the HVACR unit.

In an embodiment, a first channel of the one or more channels includes a tubular body having a first end and a second end opposite to the first end relative to the tubular body; a pocket disposed in the tubular body; and an opening disposed on the first end of the tubular body and configured to receive a first tine of the one or more tines of the forklift into the pocket. In an embodiment, the base includes a unit base and a forklift base, the unit base is at least partially recessed into the forklift base, the forklift receptacle is disposed in the forklift base.

In an embodiment, the base includes a unit base and a forklift base. The forklift receptacle is disposed in the unit support of the frame. The unit base is attached to the unit support.

In an embodiment, the unit base includes two side members connected to two end members, and one or more support beams spanned across and attached to the two side members. The forklift base includes two side members connected to two end members. The one or more channels is spanned across and attached to the two side members of the forklift base, and one or more cutouts is disposed on a bottom side of the two side members of the unit base. The one or more cutouts is configured to respectively fit over the one or more channels of the forklift receptacle.

In an embodiment, the unit base includes one or more splice plates disposed respectively over the one or more cutouts.

In an embodiment, the forklift base includes a first guide plate attached to a first side member of the two side members of the forklift base; and a second guide plate attached to a second side member of the two side members of the forklift base. A distance between a top of the first guide plate and a top of the second guide plate is longer than a distance between a lower section of the first guide plate and a lower section of the second guide plate such that the unit base, being lowered from above the forklift base, is guided toward a center of the forklift base by the first guide plate or the second guide plate.

In an embodiment, the base includes one or more connector plates configured to attach the unit base to the forklift base.

In an embodiment, the forklift base includes one or more crane lugs disposed on the forklift base configured to receive a cable for hoisting the HVACR unit.

In an embodiment, a height of the HVACR unit is smaller than or equal to 102 inches, and a width of the HVACR unit is smaller than or equal to 102 inches.

In an embodiment, a first channel of the one or more channels is configured to receive a first tine of the one or more tines of the forklift; and a second channel of the one or more channels is configured to receive a second tine of the one or more tines the forklift. The first channel and the second channel are disposed to overlap longitudinally with the center of mass of the HVACR unit.

In an embodiment, a distance between a center of the first channel and a center of the second channel is between 54 inches and 60 inches.

In an embodiment, the pocket is at least 5 inches tall and at least 10 inches wide.

In an embodiment, the HVACR unit includes a counterweight receptacle configured to receive a counterweight configured to adjust the center of mass of the HVACR unit to a center of the forklift receptacle in the longitudinal direction.

In an embodiment, a method for transporting an HVACR unit. The method includes providing a forklift receptacle in the HVACR unit, the forklift receptacle includes one or more channels for receiving one or more tines of a forklift, and the forklift receptacle overlapping with a center of mass of the HVACR unit in a longitudinal direction of the HVACR unit; inserting the one or more tines of the forklift respectively into the one or more channels of the forklift receptacle; raising the one or more tines of the forklift to lift the HVACR unit by the forklift receptacle. The HVACR unit includes a circuit having a compressor, a first heat exchanger, a second heat exchanger, and an expander; and a heat exchanger assembly having a fan and one of the first heat exchanger and the second heat exchanger, the fan being configured to draw air through the heat exchanger assembly for exchanging thermal energy with a working fluid in the circuit. The method includes loading the HVACR unit into a bed of a truck or a trailer.

In an embodiment, the forklift receptacle is disposed in a base of a frame of the HVACR unit; and the base includes a unit base and a forklift base. The method includes lowering the unit base to be at least partially recessed in the forklift base such that: a height of the HVACR unit is smaller than or equal to 102 inches; and the forklift receptacle is supporting a weight of the HVACR unit, through the forklift base, when the HVACR unit is lifted by the forklift receptacle.

In an embodiment, the method includes guiding the lowering of the unit base, by a first guide plate and a second guide plate disposed on the forklift base, toward a center of the forklift base.

In an embodiment, the forklift receptacle is disposed in a unit support of a frame of the HVACR unit, and the forklift receptacle is configured to vertically support a weight of the HVACR unit, through the unit support of the frame, when the HVACR unit is lifted.

In an embodiment, the method includes attaching a counterweight to a counterweight receptacle on the HVACR unit; and adjusting a weight of the counterweight so that the center of mass of the HVACR unit is located at a center of the forklift receptacle in the longitudinal direction of the HVACR unit.

In an embodiment, the method includes unloading the HVACR unit from the bed of the flatbed truck using at the forklift receptacle.

BRIEF DESCRIPTION OF THE DRAWINGS

References are made to the accompanying drawings that form a part of this disclosure, and which illustrate embodiments in which the systems and methods described in this specification can be practiced.

Like reference numbers represent like parts throughout.

DETAILED DESCRIPTION

This disclosure relates generally to a heating, ventilation, air conditioning, and refrigeration (HVACR) unit. More specifically, the disclosure relates to a forklift receptacle integrated into the HVACR unit for loading and unloading the HVACR unit from a transporting vehicle.

Figure 1:
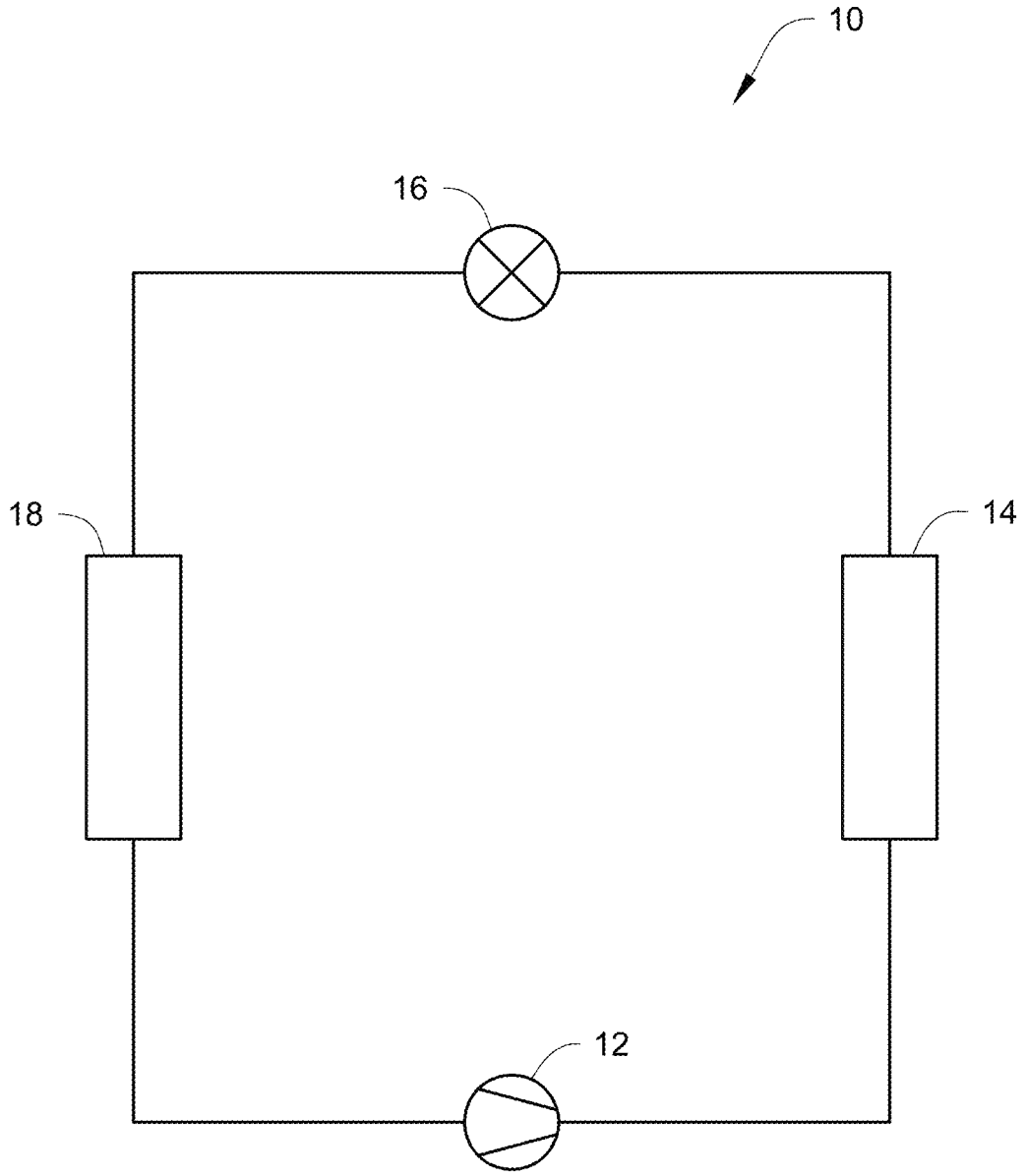
FIG. 1 is a schematic diagram of a circuit, according to an embodiment.

FIG. 1 is a schematic diagram of a circuit 10, according to an embodiment. As shown in FIG. 1, the circuit 10 includes a compressor 12, a condenser 14, an expander 16, and an evaporator 18. The compressor 12 can be, for example, a scroll compressor, a screw compressor, reciprocating compressor, centrifugal compressor, or the like.

The circuit 10 is exemplary and can include additional components. For example, in an embodiment, the circuit 10 includes other components such as, but not limited to, an economizer heat exchanger, one or more flow control devices, a receiver tank, a dryer, a suction-liquid heat exchanger, or the like. In embodiments, the circuit 10 can be configured to perform a single stage, two stages, or more than two stages of vapor-compression cycle(s).

The compressor 12, the condenser 14, the expander 16, and the evaporator 18 are fluidly connected by a working fluid. In an embodiment, the circuit 10 can be configured to be a cooling system (e.g., an air conditioning system) capable of operating in a cooling mode. In an embodiment, the circuit 10 can be configured to be a heat pump system that can operate in both a cooling mode and a heating/defrost mode.

The circuit 10 can operate according to generally known principles. The circuit 10 can be configured to heat or cool a liquid process fluid (e.g., a heat transfer fluid or medium such as, but not limited to, water, glycol, or the like), in which case the circuit 10 may be generally representative of a liquid chiller system. The circuit 10 can alternatively be configured to heat or cool a gaseous process fluid (e.g., a heat transfer medium or fluid such as, but not limited to, air or the like), in which case the circuit 10 may be generally representative of an air conditioner or heat pump.

In operation, the compressor 12 compresses a working fluid (e.g., a heat transfer fluid such as a refrigerant or the like) from a relatively lower pressure gas to a relatively higher-pressure gas. The relatively higher-pressure gas is also at a relatively higher temperature, which is discharged from the compressor 12 and flows through the condenser 14. In an embodiment, the condenser 14 and/or the evaporator 18 can include a plurality of heat exchanging coils connected in series or parallel.

Figure 2:
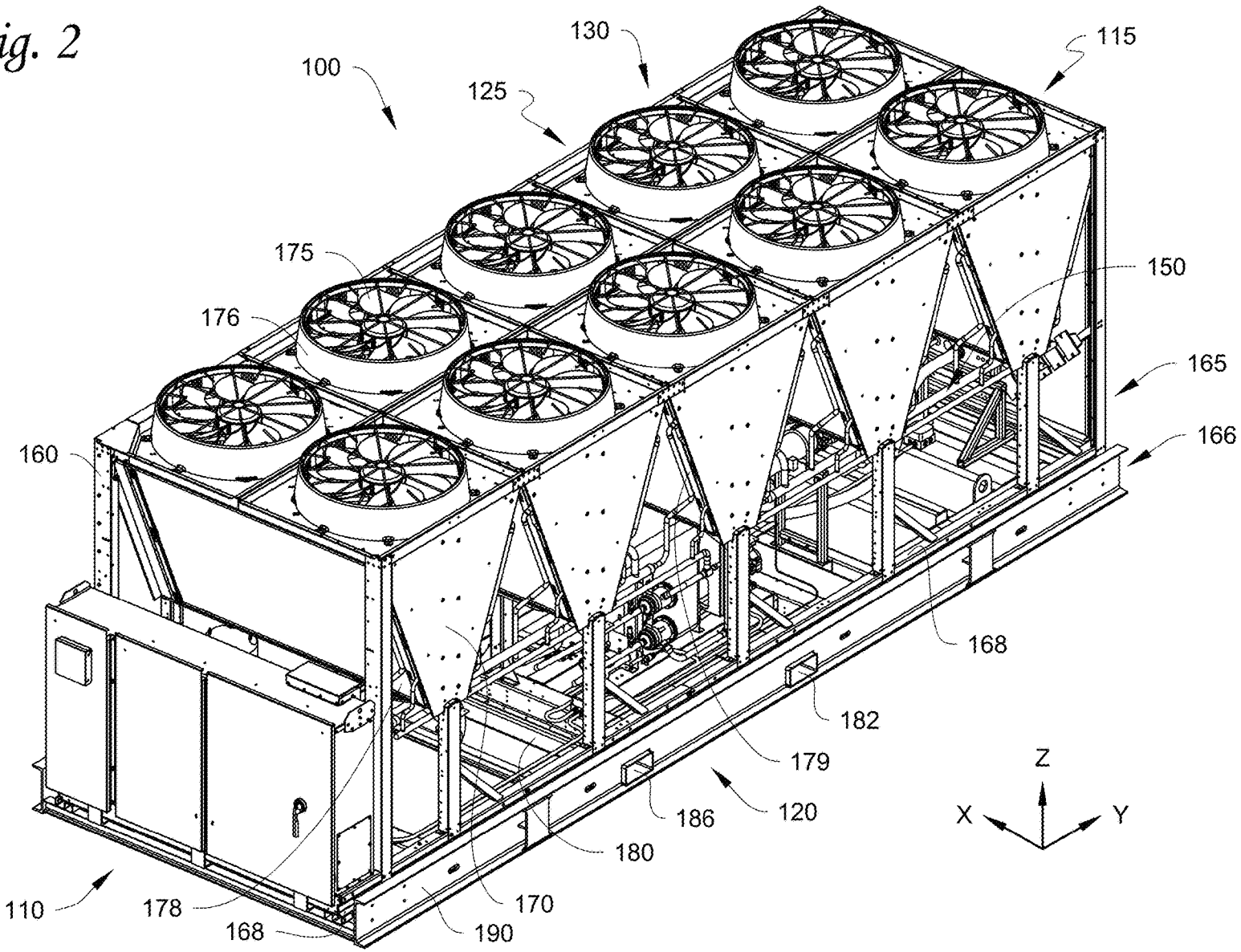
FIG. 2 is a perspective view of an HVACR unit, according to an embodiment.

FIG. 2 is perspective view of an HVACR unit 100, according to an embodiment. The perspective view of FIG. 2 shows a first end 110, a first side 120, and a top 130 of the HVACR unit 100. The HVACR unit 100 includes a circuit 150. In an embodiment, the circuit 150 can be the circuit 10 as shown and described in accordance with FIG. 1.

As illustrated in FIG. 2, the HVACR unit 100 includes a circuit 150, a frame 160, and one or more heat exchanger assemblies 170 disposed in the frame 160. The HVACR unit 100 further includes a forklift receptacle 180 for receiving one or more tines of a forklift to lift the HVACR unit 100. In an embodiment, the HVACR unit 100 includes a forklift base 190.

The circuit 150 is configured to provide climate control to a controlled space. In an embodiment, the circuit 150 includes a compressor, a first heat exchanger, a second heat exchanger, and an expander (shown in FIG. 1). The compressor, the first heat exchanger, the second heat exchanger, and the expander are in fluid communication by a working fluid included in the circuit 150. One of the first heat exchanger and the second heat exchanger can be an evaporator (e.g., evaporator 18 of FIG. 1). The other one of the first heat exchanger and the second heat exchanger can be a condenser (e.g., condenser 14 of FIG. 1). In an embodiment, the circuit 150 can include one or more compressors, first heat exchangers, second heat exchangers, and/or expanders respectively, e.g., for providing a large climate control capacity. The large climate control capacity can be 120, 140, 160, 180, 200 tons (nominal), or more.

In an embodiment, corresponding components of the circuit 150 can be included in the HVACR unit 100. Corresponding components can include one or more controllers, sensors, pumps, fluid control devices, conduits, conduit couplings, connecters, safety devices, and/or the like.

The frame 160 provides a structure for supporting some or all of the circuit 150 and its corresponding components. In an embodiment, the frame 160 includes a unit support 165 disposed on a base 166. The unit support 165 can be an upper portion of the frame 160 for providing support in the lateral and/or longitudinal direction for the heat exchanger assembly 170, the corresponding components, or the like. The unit support 165 can be configured to transfer weight to the base 166 to provide vertical support. The base 166 is a lower portion of the frame 160 for providing vertical support, e.g., for the heat exchanger assembly 170, the corresponding components, or the like. In an embodiment, the frame 160 supports, at least, the compressor, the condenser, the evaporator, and the expander of the circuit 150. In an embodiment, the lateral direction can be X, the longitudinal direction can be Y, and the vertical direction can be Z as shown in FIG. 2.

The one or more heat exchanger assemblies 170 can each be configured to include one or more fans 175 and one or more heat exchangers 178 for the working fluid to exchange thermal energy with the air. The one or more heat exchanger assemblies 170 can be supported by the frame 160. As illustrated in the embodiment of FIG. 2, five heat exchanger assemblies 170 are included in the frame 160. The heat exchanger assemblies 170 are arranged in the longitudinal direction of the HVACR unit 100 from the first end 110 to a second end 115. It is appreciated that, in some embodiments, the HVACR unit 100 can include two, three, four, five, or more heat exchanger assemblies 170.

The heat exchanger assembly 170 includes the heat exchanger 178 and one or more fans 175. It is appreciated that the heat exchanger 178 can include one or more heat exchanging units or sections for exchanging thermal energy. In an embodiment of the HVACR unit 100 being configured to be a chiller that can be operated in a cooling mode, the heat exchanger 178 in the heat exchanger assembly 170 is operated as an evaporator. In another embodiment of the HVACR unit 100 being configured to be a heat pump that can be operated in a cooling mode, or a heating/defrosting mode. In such embodiment, the heat exchanger 178 in the heat exchanger assembly 170 is operated as an evaporator in a cooling mode, or a condenser in a heating or defrosting mode.

The one or more fans 175 is configured to draw air through the heat exchanger assembly 170 for exchanging thermal energy with the working fluid. In the illustrative example of FIG. 2, two fans 175 are arranged from the first side 120 to a second side 125 of the HVACR unit 100 in each heat exchanger assembly 170. In an embodiment, the fans 175 are included in a fan housing 176. The fan housing 176 is disposed over the heat exchanger 178, or a heat exchanger frame 179, for drawing air through the heat exchanger assembly 170. In an embodiment, the fan 175 is configured to draw air through the heat exchanger 178.

The forklift receptacle 180 is included in the HVACR unit 100 and configured to receive one or more tines of a forklift for lifting the HVACR unit 100. The forklift can lift the HVACR unit 100 with the tines at the forklift receptacle 180. The forklift receptacle 180 can include one or more channels (e.g., channels 182, 186) arranged to respectively received the one or more tines of a forklift. In the illustrative example of FIG. 2, the forklift receptacle 180 includes a first channel 182 and a second channel 186 for respectively receiving the two tines of a forklift. The forklift receptacle 180 can be configured such that a center of gravity of the HVACR unit 100 in a longitudinal direction is positioned within a width of the forklift receptacle 180 along said longitudinal direction. For example, the first channel 182 and second channel 186 can be arranged such that the center of gravity of the HVACR unit 100 in the longitudinal direction can be between said first and second channels 182, 186. The HVACR unit can thus be lifted using the forklift receptacle 180 without tipping to either side.

The forklift receptacle 180 is integrated into HVACR unit 100. In an embodiment, the forklift receptacle 180 is located in the frame 160, with corresponding supporting structures for lifting the HVACR unit 100 at the forklift receptacle 180 located in the frame 160. In another embodiment, the forklift receptacle 180 is located in the base 166 of the frame 160. In yet another embodiment, the forklift receptacle 180 is located in the forklift base 190.

In an embodiment, the base 166 of the frame 160 includes a unit base 168. The unit base 168 is configured to vertically support the HVACR unit 100. In an embodiment, the unit base 168 provides such vertical support by distributing the weight of the HVACR unit 100 to a support surface, when the HVACR unit 100 is placed on a support surface (e.g., a ground, a rooftop, a bed of a truck or the like).

In an embodiment, the unit base 168 is configured to support the weight of the HVACR unit 100 when suspended by a forklift receptacle 180 disposed in the frame 160, or the unit support 165 of the frame 160, for lifting the HVACR unit 100. In such embodiment, the frame 160 can include reinforcement members connecting the forklift receptacle 180 to the unit base 168, the unit support 165, or the like, so that the weight HVACR unit 100 can be suspended at the forklift receptacle 180 without damages, for example, from frame deflections.

In another embodiment, the base 166 includes a unit base 168 and a forklift base 190. The unit based 168 is configured to transfer the weight of the HVACR unit 100 across the forklift base 190. The forklift base 190 is configured to support the weight of in the HVACR unit 100 when the HVACR unit 100 is lifted by the forklift receptacle 180. The forklift base 190 can be included in the HVACR unit 100 for providing vertical support for the HVACR unit 100, for reducing deflection of the HVACR unit 100, and/or for including the forklift receptacle 180. The forklift base 190 is configured to receive the frame 160 such that the frame 160, and/or the unit base 168, is recessed at least partially into the forklift base 190.

It is appreciated that, the HVACR unit 100 operates the circuit 10 to exchange thermal energy with a process fluid (e.g., air, water, glycol, combinations thereof, or the like). The HVACR unit 100 can be an air-cooled chiller in an embodiment. In such embodiment, the circuit 150 can be configured to cool the process fluid. In another embodiment, the HVACR unit 100 can be configured to be an air conditioner or heat pump. In such embodiment, the circuit 150 can be configured to heat or cool the process fluid. The circuit 10 can be applied in a variety of systems to provide climate control (e.g., controlling temperature, humidity, air quality, or the like) to a controlled space. The controlled space can be a room, an office, a house, a building, a warehouse, a factory, a commercial building, and the like. An HVACR unit 100, having the circuit 10, can be disposed remotely from the controlled space. For example, the HVACR unit can be located on the ground next to, or on the roof of, a building for providing climate control for an interior of the building through air duct(s). In an embodiment, the HVACR unit 100 can be a packaged unit that contains, in a frame or housing, at least the compressor, the condenser, the evaporator, and the expander of the circuit 150 for providing climate control to the controlled space.

Figure 3:
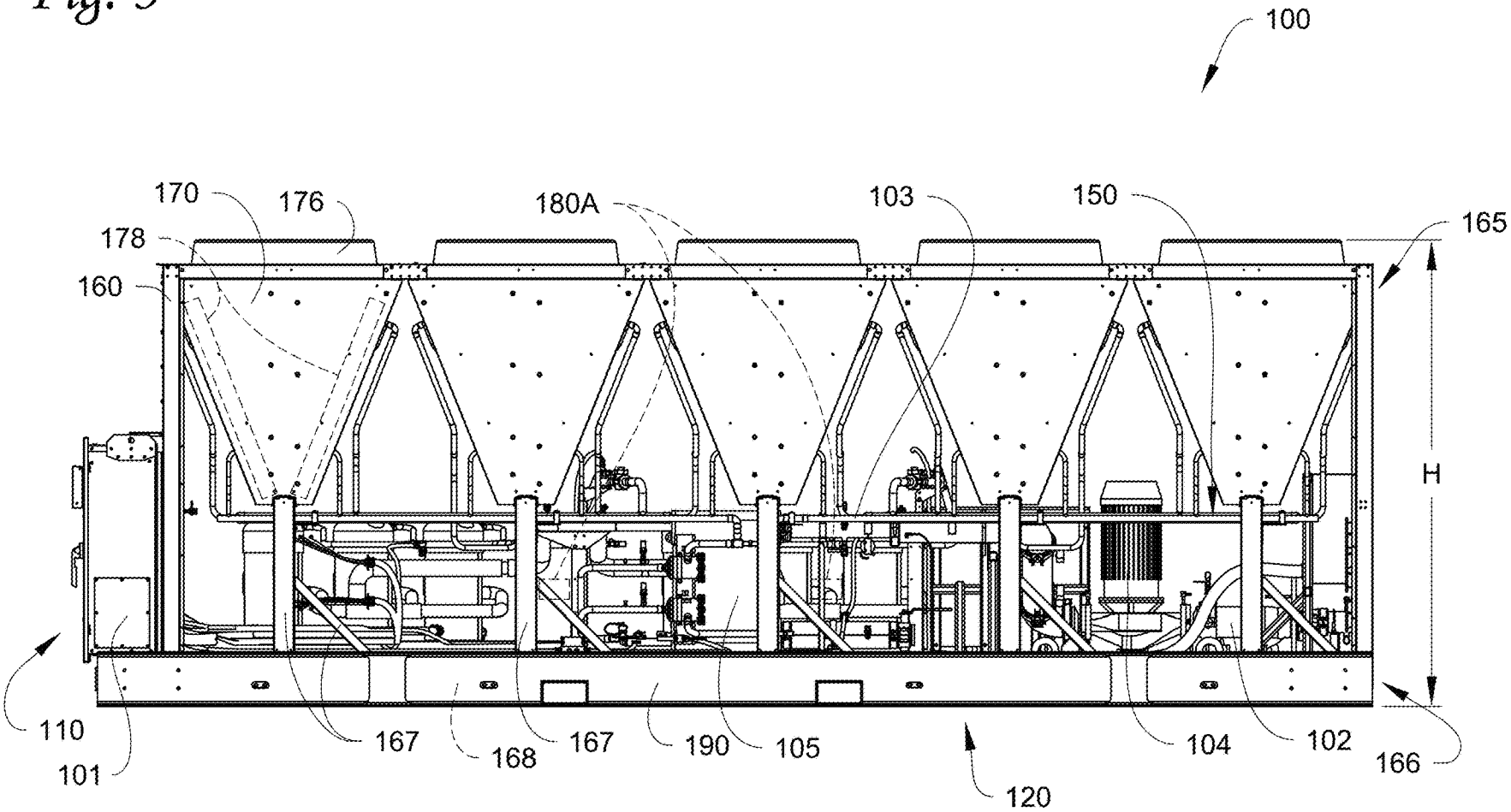
FIG. 3 is a side view of the HVACR unit in FIG. 2, according to an embodiment.

FIG. 3 is a side view of the HVACR unit 100, according to an embodiment. As shown in FIG. 3, the HVACR unit 100 is shown from the first side 120 of the HVACR unit 100. The frame 160 can include the unit support 165 and the base 166. Components of the HVACR unit 100 can be disposed in and/or supported by the frame 160. For example, in the illustrated embodiment, one or more controllers 101, pumps 102, conduits 103, compressor 104, heat exchanger 105, or the like, can be disposed in and/or supported by the frame 160, the support members, the base 166, and/or the like.

The unit support 165 includes one or more supporting members 167 that, e.g., connects the one or more heat exchanger assemblies 170 to the frame 160, and/or providing supports in the lateral direction, the longitudinal direction, and/or the vertical direction of the HVACR unit 100.

The forklift base 190 can be included in the HVACR unit 100 for providing vertical support for the HVACR unit 100, for reducing deflection of the HVACR unit 100, and/or for including the forklift receptacle 180. The unit base 168 (obstructed) extends into and is supported by the forklift base 190. For example, such vertical support can be provided when the HVACR unit 100 is lifted by a forklift such that, the forklift receptacle 180 being the contact point(s) providing a lifting force, and the other part of the HVACR unit 100 is suspended in air.

In another embodiment, the forklift receptacle 180A can be disposed in the frame 160, or the unit support 165, for providing vertical support for the HVACR unit 100, for reducing deflection of the HVACR unit 100, and/or for including the forklift receptacle 180.

The HVACR unit 100 has a height H. In an embodiment, the height H is defined as a vertical distance from a bottom of the HVACR unit 100 to the top of the HVACR unit 100. The bottom of HVACR unit 100 can be the bottom surface of the forklift base 190, the top of the HVACR unit 100 can be the highest point of the fan housing 176. The height H is at or about, or less than, 2590.8 mm or 102 inches. In an embodiment, the height H is at or about, or more than 2500 mm. In an example, a distance between the highest point of the fan housing 176 to the bottom of the unit base 168 can be at or about 2500 mm.

Figure 4:
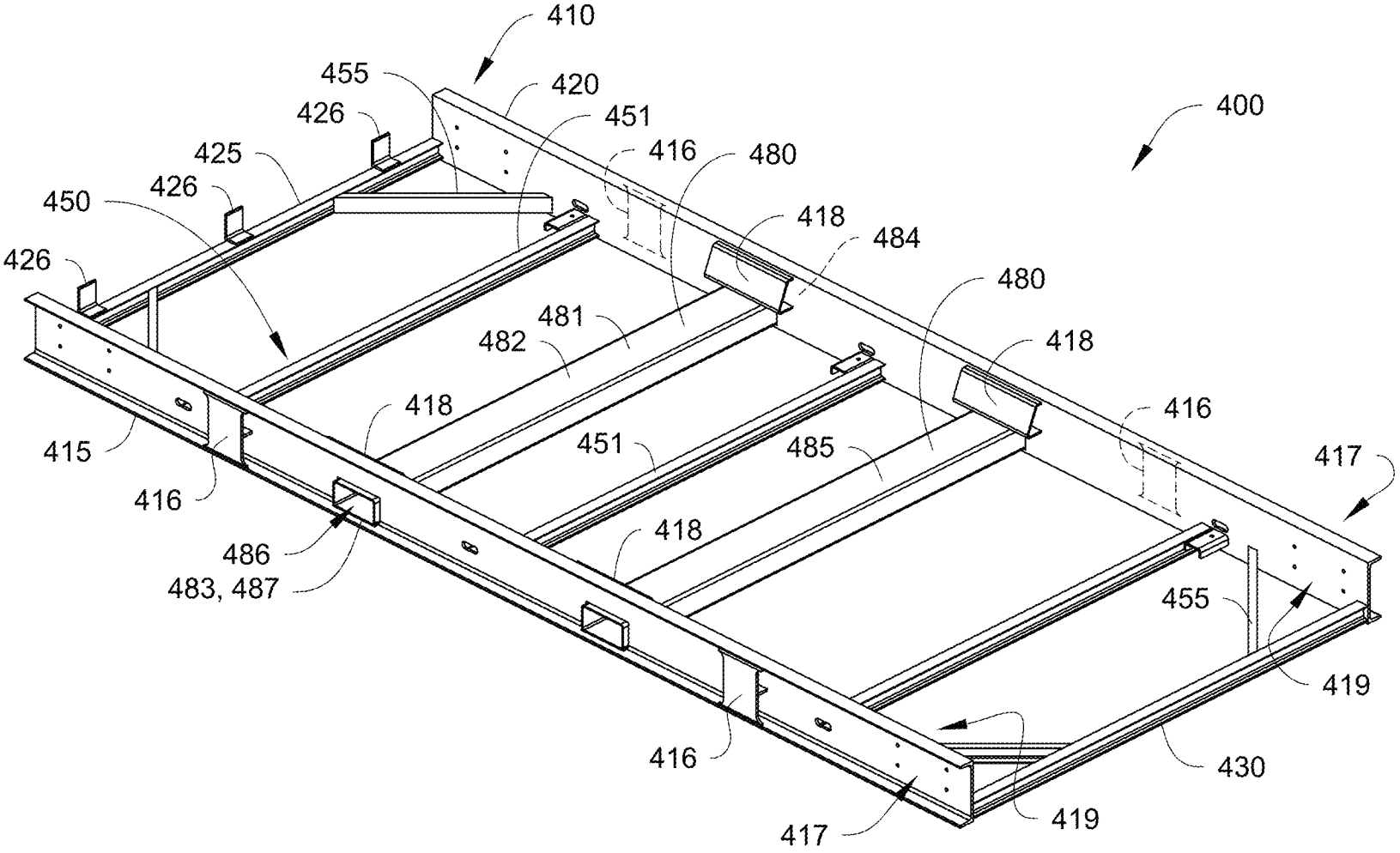
FIG. 4 is a perspective view of a forklift base, according to an embodiment.

FIG. 4 is a perspective view of a forklift base 400, according to an embodiment. In an embodiment, the forklift base 400 can be the forklift base 190 as discussed with respect to FIGS. 2 and 3.

As shown in FIG. 4, the forklift base 400 includes an outer support assembly 410 and an internal support assembly 450 disposed therein. The outer support assembly 410 includes a first side member 415, a second side member 420, a first end member 425, and a second members 430. The members 415, 420, 425, and 430 are connected to form the outer support assembly 410. In an embodiment, the first end member 425 and the first side member 415 can be located on the first end 110 and the first side 120, respectively, as shown in FIG. 2.

A plurality of crane lugs 416 are disposed on the first side member 415 and the second side member 420 respectively. The crane lugs 416 can be one or more lifting plates providing anchor points that are suitable for receiving and attaching one or more cables for crane lifting. It is appreciated that, in an embodiment, the crane lugs 416 disposed on the second side member 420 are obstructed by the second side member 420. In an embodiment, the crane lugs 416 are attached to an outer side 417 of the first side member 415 and the second side member 420.

A plurality of guide plates 418 are disposed on the first side member 415 and the second side member 420 respectively. In the view of FIG. 4, the guide plates 418 on the first side member 415 is obstructed by the first side member 415. In an embodiment, the guide plates 418 are disposed on the inner side 419 of the first side member 415 and the second side member 420. The guide plates 418 are configured to guide the unit base (shown in FIGS. 2 and 3) toward the center of the forklift base 400 as further discussed with respect to FIG. 8 when said unit base is placed into the forklift base 400.

One or more position limiters 426 can be disposed on the first end member 425. The limiters 426 can be configured to control the longitudinal position of, e.g., the unit base (shown in FIGS. 2 and 3) when the unit based is disposed in the forklift base 400. In an embodiment, the limiters 426 can be an L-bracket with a base attached to the first end member 425 and a body extending upward from the base. The body can contact and stop the first end 110 of the unit base (shown in FIGS. 2 and 3) when the unit based is moving in the longitudinal direction toward, before exceeding, the first end member 425.

The internal support assembly 450 includes one or more cross supports 451 and/or corner supports 455 for providing rigidity to the forklift base 400. The cross supports 451 are disposed across and attached to the first side member 415 and the second member 420. The corner supports 455 are configured to be attached to one of the side members 415, 420 to one of the end members 425, 430. In an embodiment, the cross supports 451 and/or the corner supports 455 are arranged to provide vertical support to the weight of the HVACR unit, and transferring the weight from the supports 451, 455, to the side members 415, 420, and to the forklift receptacle 480.

The forklift receptacle 480 spans across and attaches to the first side member 415 and the second side member 420. In an embodiment, the forklift receptacle 480 can be the forklift receptacle 180 as shown and described with respect to FIGS. 2 and 3. The forklift receptacle 480 can include one or more channels configured to respectively receive one or more tines of a forklift of lifting the HVACR unit. In the illustrated example, the forklift receptacle 480 includes a first channel 481 and a second channel 485. The channel 481 includes a tubular body 482 having a first end 483 and a second end 484 opposite to the first end 483 relative to the tubular body 482. A pocket 486 is disposed in the tubular body 482. An opening 487 disposed on the first end 483 of the tubular body 482 and configured to receive a first tine of the one or more tines of the forklift into the pocket 486.

It is appreciated that, in an embodiment, the forklift receptacle 480 can have any shape so long as the channel(s) can receive the tine(s) of a forklift that is suitable to support the weight of the HVACR system, and stably transporting, loading, and unloading the HVACR unit to a flatbed truck.

It is further appreciated that, one or more, or all, of the members 415, 420, 425, and 430, and the support members 451, 455 can be an I-beam or C-channel beam to provide rigidity for forklift base 400 to support the weight of the HVACR unit (e.g., HVACR unit 100 of FIGS. 2 and 3) when the HVACR unit is lifted at a forklift receptacle 480.

Figure 5:
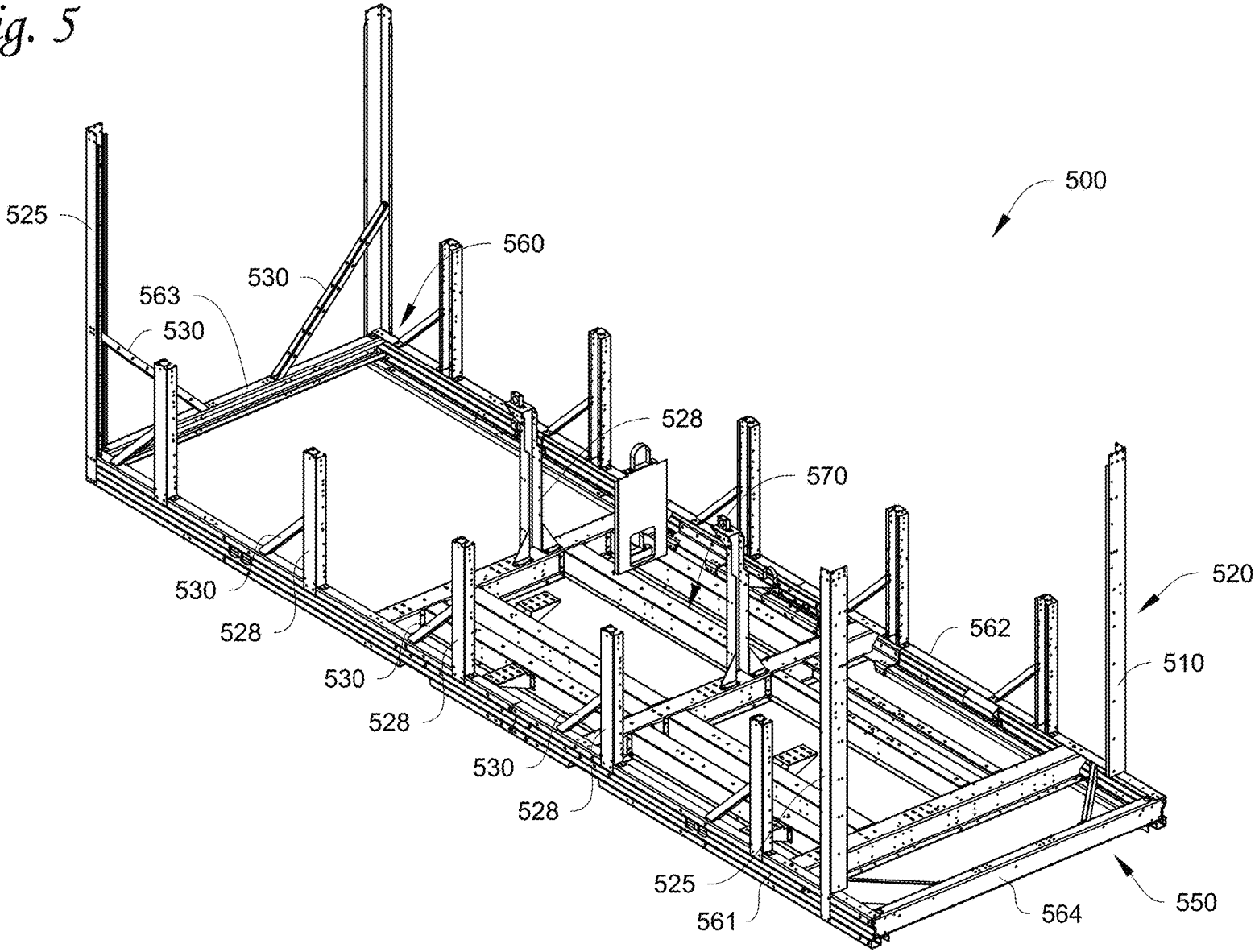
FIG. 5 is a perspective view of a unit support and a unit base of a frame, according to an embodiment.

FIG. 5 is a perspective view of a unit support 510 and a unit base 550 of a frame 500, according to an embodiment. The unit support 510, the unit base 550, and the frame 500 can be the unit support 165, the unit base 168, and the frame 160. The unit base 550 can be configured to fit into the forklift base 400 as shown, e.g., in FIGS. 2 and 3.

As shown in FIG. 5, the unit base 550 includes an outer support assembly 560 and an internal support assembly 570 disposed therein. The outer support assembly 560 includes a first side member 561 and a second side member 562 connected to a first end member 563 and a second end member 564. In an embodiment, the outer support assembly 560 and/or the inner support assembly 470 is configured to rest on top of the inner support assembly 450 and/or the forklift receptacle 480 (shown in FIG. 4) as illustrated, for example in FIG. 2.

The first side member 561 and the second side member 562 can be two rails configured for connecting the end members 563, the interior support assembly 570, and/or the unit support 510.

The unit support 510 includes one or more supporting members 520 configured to support, for example, the heat exchanger assemblies 170 of FIGS. 2 and 3. In an embodiment, the supporting members 520 raises the heat exchanger assemblies above the other components of the HVACR unit such that air can be drawn through the heat exchanger assemblies, with less obstructions from the other components, to exchanger thermal energy with the working fluid.

The supporting members 520 includes a plurality of corner poles 525, a plurality of internal poles 528, and a plurality of angled braces 530 for reinforcing the corner poles 525 and/or the internal poles 528.

As shown in FIG. 5, the corner poles 525 are disposed on the exterior support assembly 560 at or near a corner of a side member 562 or 562 and an end member 563 or 564. The internal poles 528 can be disposed on the exterior support assembly 560 or the interior support assembly 570 of the frame 500.

Figure 6:
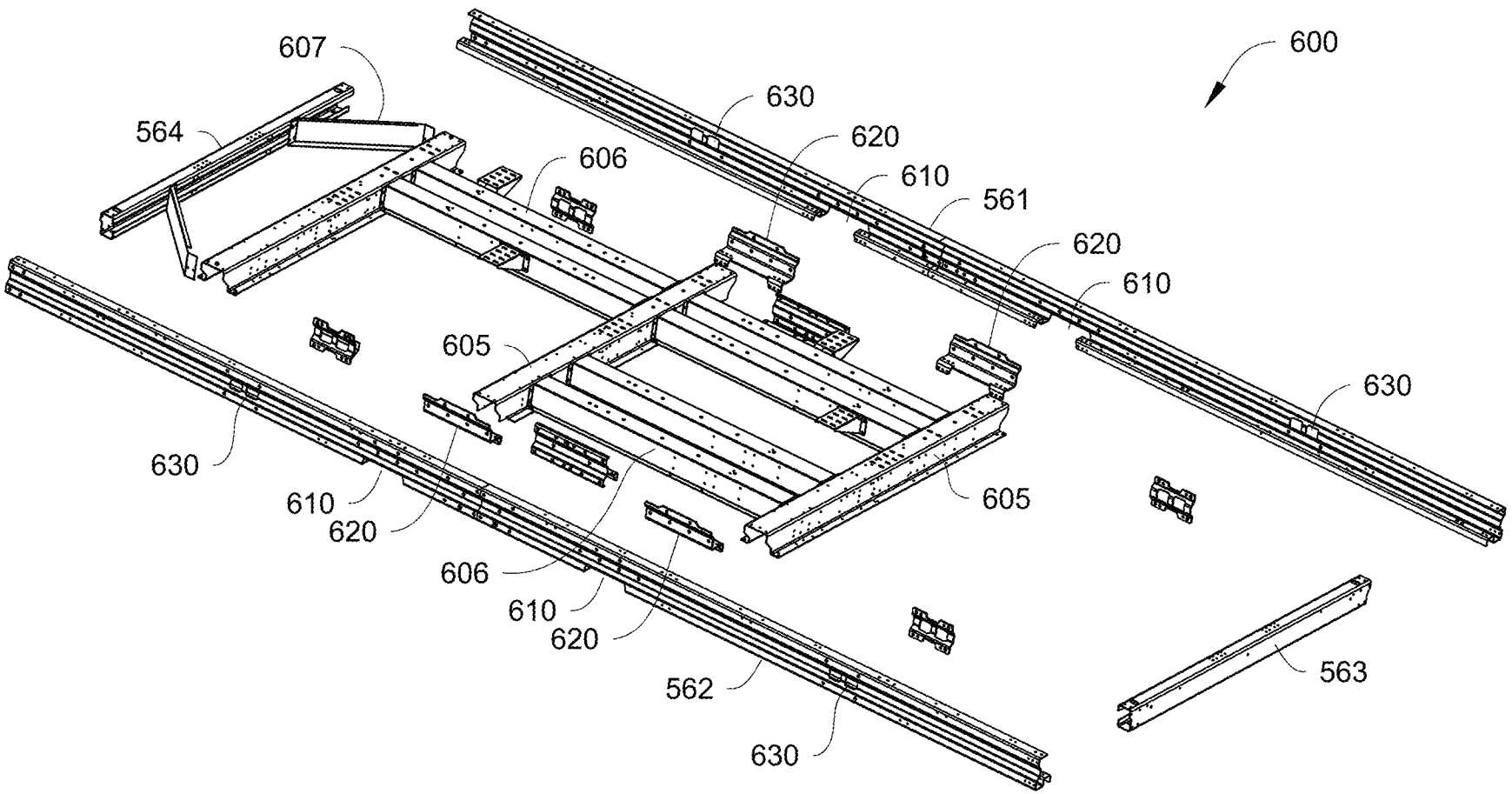
FIG. 6 is an exploded view of a unit base, according to an embodiment.

FIG. 6 is an exploded view of a unit base 600, according to an embodiment. In an embodiment, the unit base 600 can be the unit base 550 of FIG. 4 and the unit base 168 of FIGS. 2 and 3.

As shown in FIG. 6, the unit base 600 includes the first side member 561 and the second side member 562, the first end member 563, and the second end member 564. HVACR unit components such as compressors, heat exchangers, pumps, sensors, or the like, can be disposed on the unit base 600.

The unit base 600 includes one or more cross supports 605 spans access and attaches to the first side member 561 and the second side member 562. One or more support rails 606 is disposed between the cross supports 605 and/or the end members 563, 564. One or more angled supports 607 can be disposed between the side members 561, 562, the end members 563, 564, the cross supports 605, and/or the support rails 606.

The cross supports 605, support rails 606, and/or the angled supports 607 are configured to support HVACR unit components and/or to transfer the weight to other members in the base of the HVACR unit. In an embodiment, one or more the cross supports 605 can be configured to rest on the cross support of the forklift base and the forklift receptacle (e.g., cross support 451 in FIG. 4) when the unit base 600 is seated, and at least partially recessed, in a forklift base. In an embodiment, one or more the angled supports 607 can be configured to rest on the corner support (e.g. 455 of FIG. 4) when the unit base 600 is seated in a forklift base.

One or more cutouts 610 is disposed on a bottom side of the two side members 561, 562 of the unit base 600, the one or more cutouts 610 is configured to respectively fit over the forklift receptacle (e.g., forklift receptacle 480 of FIG. 4). In an embodiment, the one or more cutouts 610 is configured to respectively fit over the one or more channels of the forklift receptacle. It is appreciated that by fitting cutouts 610 over the forklift receptacle, the bottom surface of the side members 561, 562 can be disposed at a location lower than a top of the channels of the forklift receptacle, recessing the unit base 550 into the forklift base. In the illustrative example of FIG. 6, the two cutouts 610 are disposed on each of the side members 561, 562.

One or more splice plates 620 is disposed respectively over the one or more cutouts 610 from above the cutouts 610. The one or more cross supports 605 can be disposed over the splice plates 620 for attaching the first side member 561 and/or the second side member 562 via the splice plates 620.

A plurality of crane lugs 630 disposed on the first side member 561 and second side member 562. The crane lugs 630 can be holes in the side members 561, 562 that provide anchor points for receiving and attaching one or more cables for crane lifting.

Figure 7A:
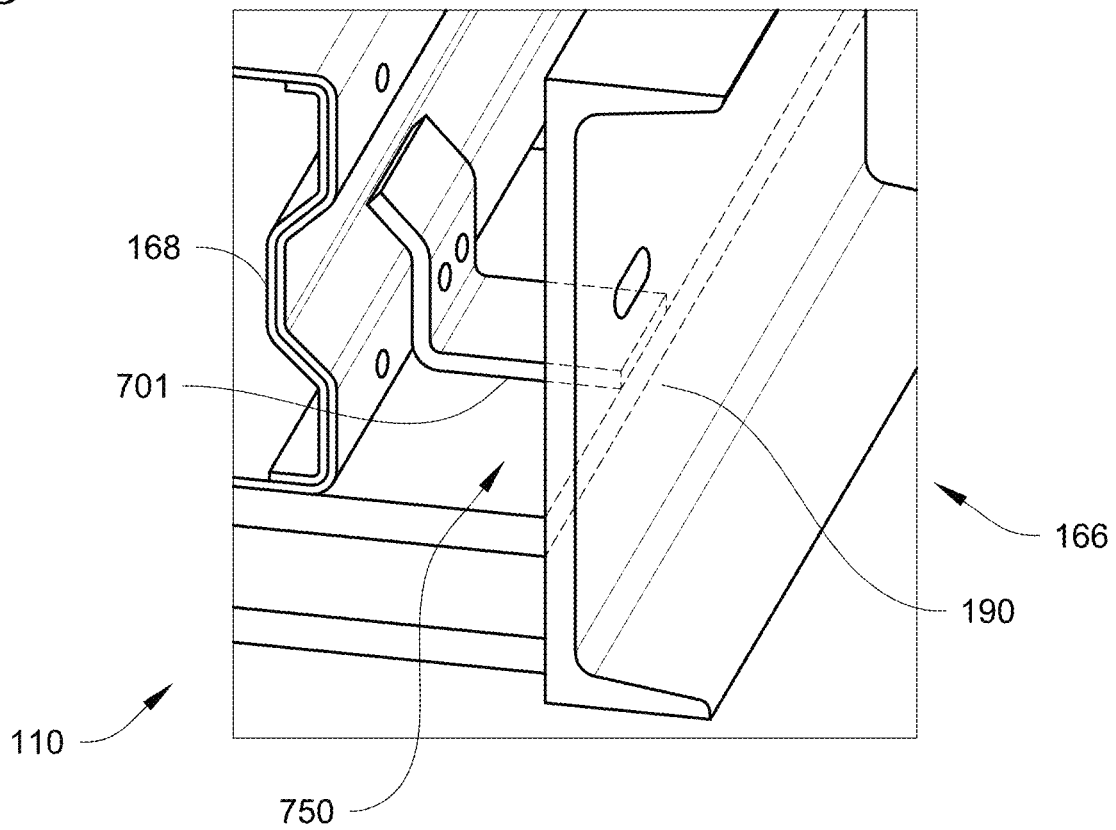
FIG. 7A is a detailed view of the HVACR unit, according to an embodiment.
Figure 7B:
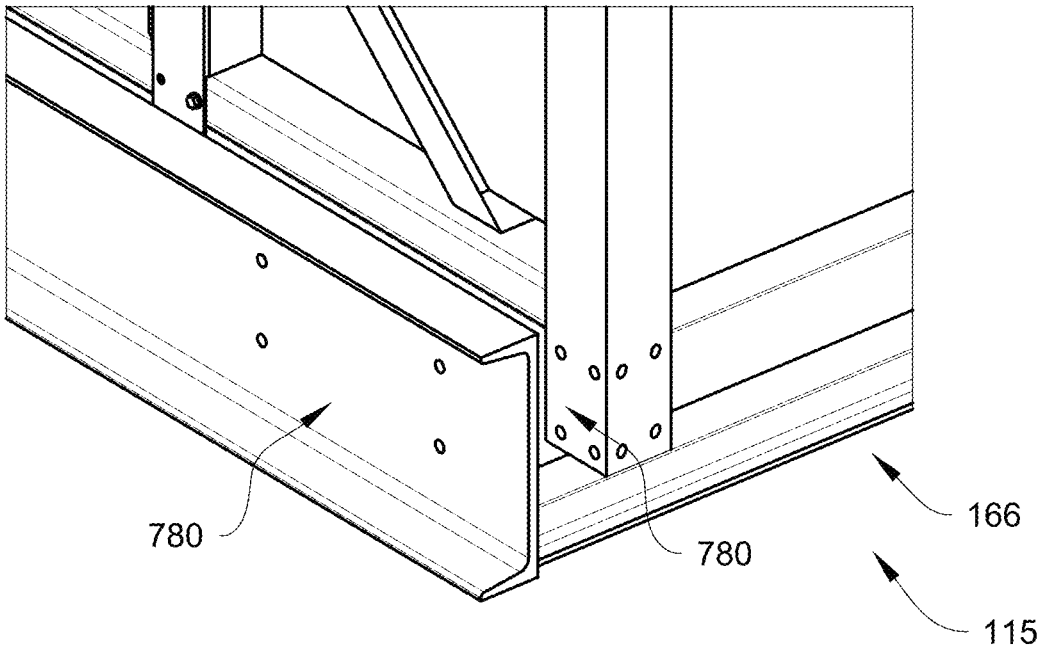
FIG. 7B is another detailed view of the HVACR unit, according to an embodiment.

FIGS. 7A and 7B are detailed view of the HVACR unit 100, according to an embodiment. FIG. 7A can be a detailed view at a corner between the first end 110 and the first side 120 as shown in FIG. 2. FIG. 7B can be a detailed view at a corner between the second end 115 and the first side 120 as shown in FIG. 2.

As shown in FIG. 7A, one or more connecter plates 701 can be disposed between the unit base 168 and the forklift base 190 for attaching the unit base 168 to the forklift base 190 when the unit base 168 is seated in the forklift base 190. In an embodiment, the connector plates 701 can be an L-bracket or Z-bracket for connecting a horizontal outer side of the unit base 168 to a horizontal surface on an inner side of the forklift base 190. It is appreciated that, while in FIG. 7A, the connects plate 701 is disposed at a corner, the connecter plates 701 can be included in a longitudinal space 750 between the forklift base 190 and the unit base 168. The longitudinal space 70 can be on the first side (e.g., first side 120 in FIG. 2) and/or the second side (e.g., second side 125 in FIG. 2) of the HVACR unit.

As shown in FIG. 7B, one or more counterweight receptacles 780 can be included in the HVACR unit 100 for adjusting a center of mass of the HVACR unit 100. The counterweight receptacles 780 can be one or more through holes on the base 166 for receiving a fastener to attach a counter weight to the HVACR unit 100. As shown in FIG. 7B, the counterweight receptacles 780 is disposed on the second end 115 of the HVACR unit 100. In some embodiments, the counterweight receptacles 780 can be disposed on the first end 110 and/or the second side 125 of the HVACR unit 100. In embodiments, counterweights can be attached at counterweight receptacles 780 in order to manipulate the center of gravity of the HVACR unit 100, for example to allow adjustment of the center of gravity such that the center of gravity is, in the longitudinal direction, between the ends of the forklift receptacle of said HVACR unit 100.

Figure 8:
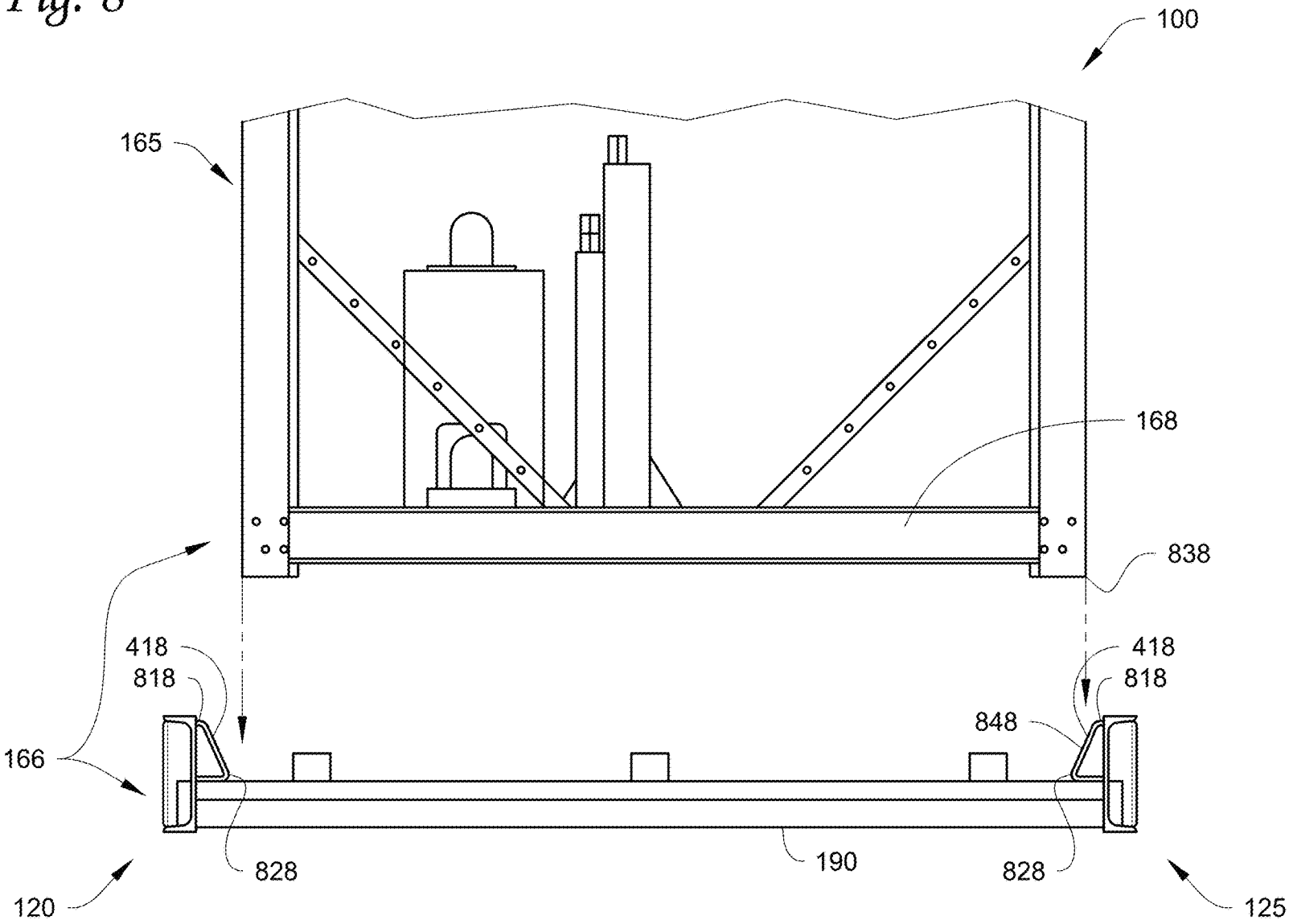
FIG. 8 is schematic view of a unit base being lowered into a forklift base, according to an embodiment

FIG. 8 is schematic view of the unit base 168 being lowered into the forklift base 190, according to an embodiment. As shown in FIG. 8, the HVACR unit 100 is assembled by lowering the unit base 168 into the forklift base 190, e.g., by a crane. A distance between an upper portion 818 of the guide plates 418 on the first side 120 and the second side 125 is longer, or wider, then a distance between a lower portion 828 of the guide plates 418. According, when the unit base 168 is off centered (e.g., too close to the second side 125 as in FIG. 8), a lower corner 838 of the unit base 168 will make contact with a surface 848 of the guide plate 418 on the second side 125. When the unit base 168 is further lowered, the lower corner 838 will slide against the guide plate 418, guiding the unit base 168 toward the center of the forklift base 190.

FIGS. 9A-9D are illustrative, non-limiting examples showing examples of the weight distribution relative to the forklift receptacles, according to some embodiments. In the illustrative examples of FIGS. 9A-9D, the forklift receptacle is disposed in the forklift base and a center-to-center distance between two channels of the forklift receptacle is 60 inches.

Figure 9A:
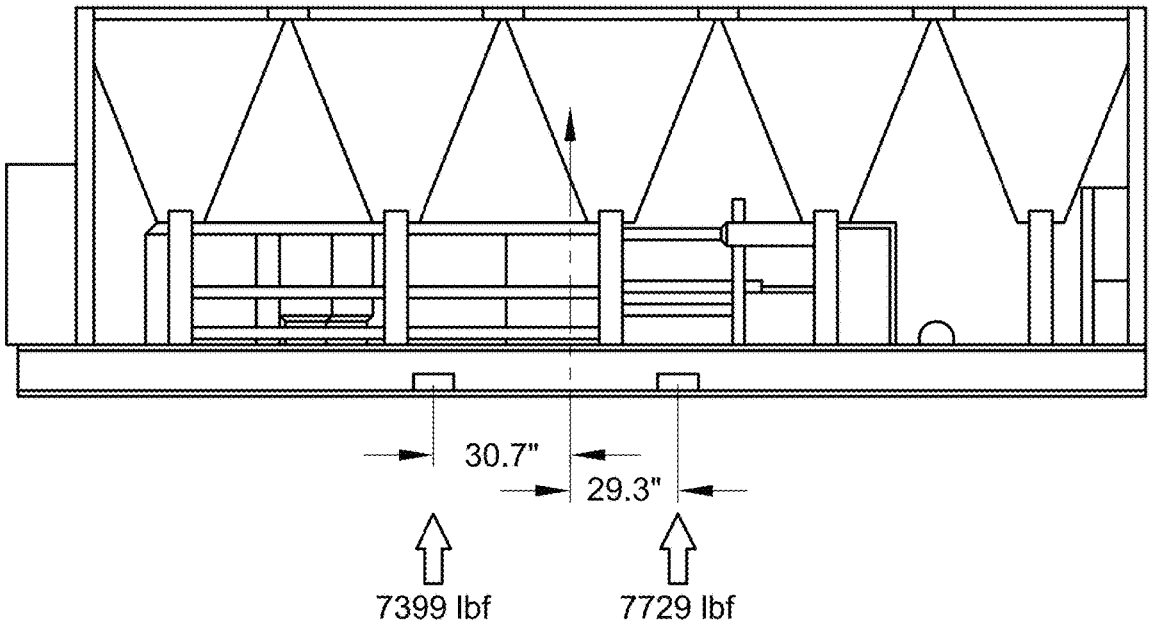
FIGS. 9A-9D are illustrative examples of the weight distribution on the forklift receptacles, according to some embodiment.

The embodiment of FIG. 9A is a cooling unit having an overall weight of 15128 lbs. The center of mass is 30.7 inches and 29.3 inches from the two channels respectively. 7399 pound-force (lbf) and 7729 lbf are supported at the two channels respectively.

Figure 9B:
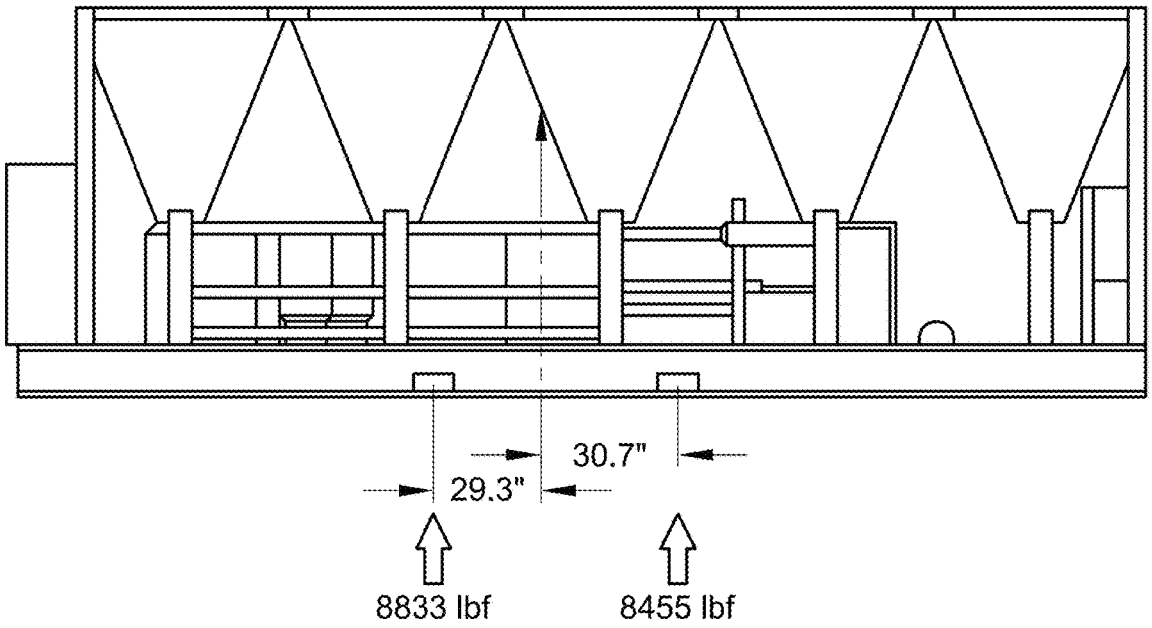

The embodiment of FIG. 9B is a heat pump unit having an overall weight of 17288 lbs. The center of mass is 30.7 inches and 29.3 inches from the two channels respectively. 8833 lbf and 8455 lbf are supported at the two channels respectively.

Figure 9C:
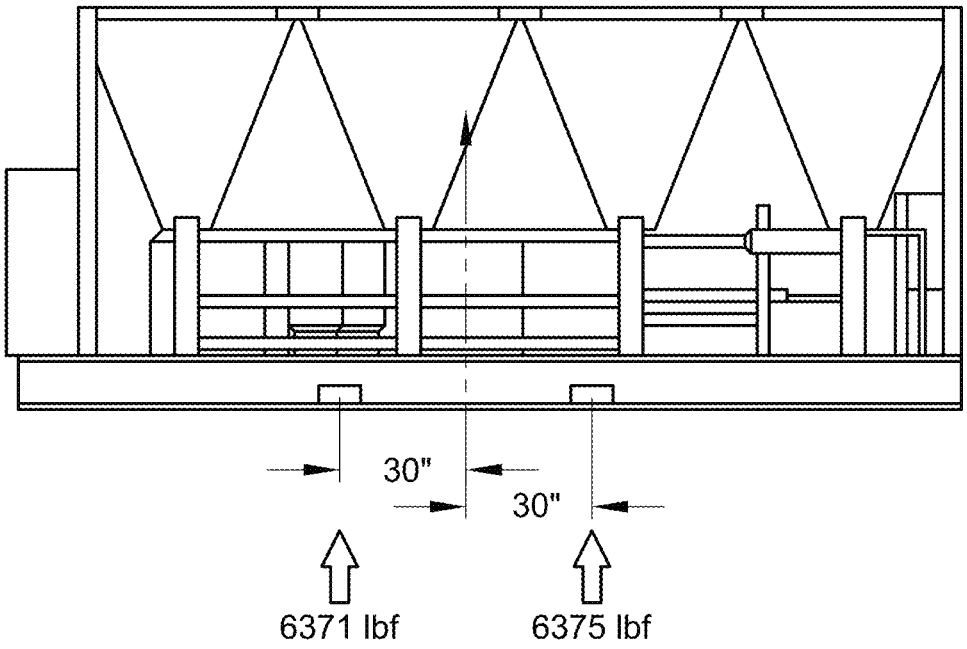

The embodiment of FIG. 9C is a cooling unit having an overall weight of 12746 lbs. The center of mass is 30 inches from the two channels respectively. 6371 lbf and 6375 lbf are supported at the two channels respectively.

Figure 9D:
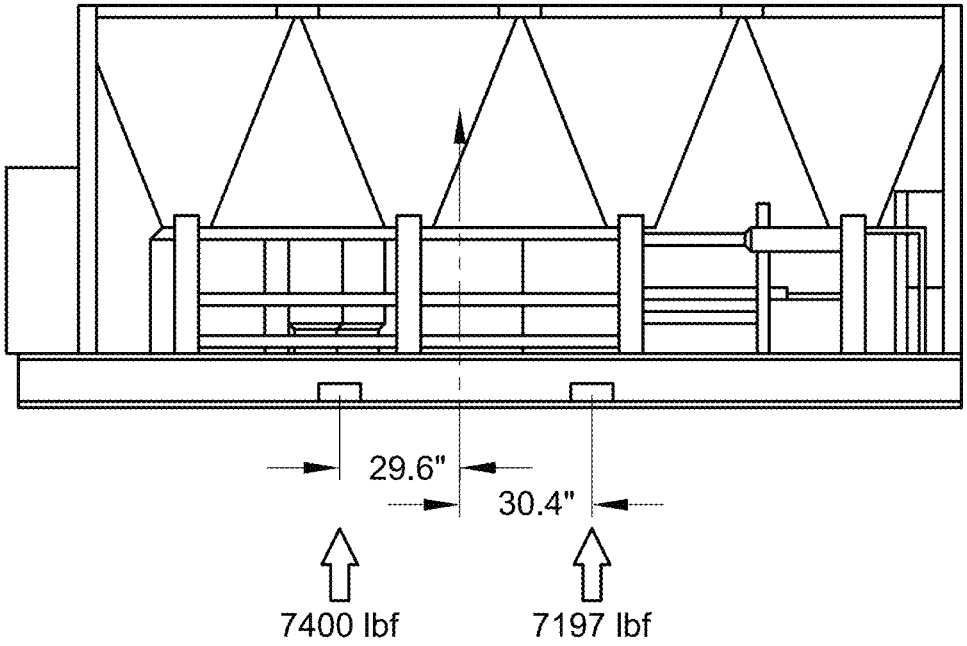

The embodiment of FIG. 9D is a heat pump unit having an overall weight of 14591 lbs. The center of mass is 29.6 inches and 30.4 inches from the two channels respectively. 7400 lbf and 7197 lbf are supported at the two channels respectively.

As illustrate in FIGS. 9A-9D, the forklift receptacle is arranged to be overlapped, in a longitudinal direction of the HVACR unit, with a center of mass of the HVACR unit. Arranging the center of mass of the HVACR unit to be located at or near the middle of the two channels for receiving the tines of a forklift can provide more stability, and the HVACR unit is less likely to tip over while being loaded or transported by the forklift or experience deformation of a portion of the frame of said HVACR unit.

In an embodiment, the forklift receptacle can be arranged such that a center of mass is near the middle of the two channels such that the respective weights supported by each of the channels are within 10% of one another, or within 5% of one another.

Figure 10:
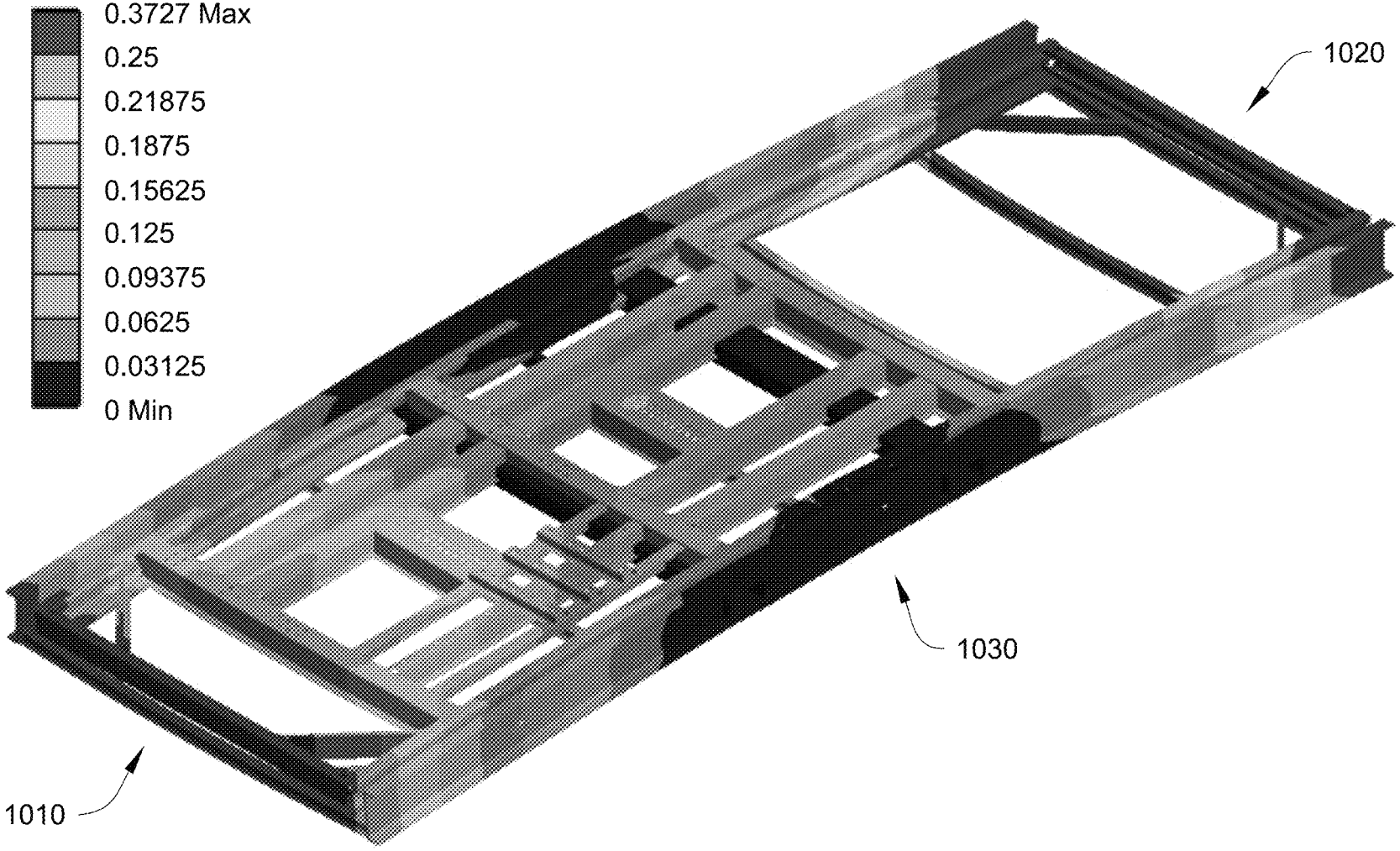
FIG. 10 is finite element analysis (FEA) of a base of an HVACR unit, according to an embodiment.

FIG. 10 shows results of finite element analysis (FEA) of a base of an HVACR unit according to an embodiment. FEA simulates the forces acting on different locations on the base when the HVACR unit is lifted by way of the forklift receptacle and shows deflection resulted from the weight being supported at the forklift receptacles. The deflection is shown in inches.

The overall length of HVACR units can generally be 200 inches to 24 feet. The channels of the forklift receptacle are disposed closer to the center due to (1) the center-to-center distance being 54 to 60 inches, (2) the center of mass of the HVACR unit being at or near the middle from the two ends (shown, e.g., in FIGS. 9A-9D), and (3) the middle of the forklift receptacle being at or near the center of mass. As shown, e.g., in FIGS. 4 and 5, the crane lugs for the crane are closer to the end of the HVACR unit. The ends of the HVACR unit being further from the forklift receptacle than to the crane lugs, causing more deflection on the ends 1010 and 1020, and nearly no deflection at the middle 1030. The base (e.g., 166 of FIG. 2) of the HVACR unit is arranged to include support members for counteract the deflection on each ends. In an embodiment, the maximum deflection allowable on the base of an HAVCR unit is 0.3727 inches.

In an embodiment, the maximum deflection allowable on the base of an HAVCR unit is 1/300 of an overall length of the HVACR unit. For example, in an embodiment of an HVACR unit having an overall length of 7155 mm, the maximum deflection allowable is 24 mm.

Aspects:

Any one of aspects 1-14 can be combined with any one of aspects 15-20.

Aspect 1. An HVACR unit, comprising:

a circuit comprising a compressor, a first heat exchanger, a second heat exchanger, and an expander;

a heat exchanger assembly having a fan and one of the first heat exchanger and the second heat exchanger, the fan being configured to draw air through the heat exchanger assembly for exchanging thermal energy with a working fluid in the circuit;

a frame having a unit support disposed on a base, the unit support being configured to laterally support the heat exchanger assembly, and the base being configured to vertically support the heat exchanger assembly; and a forklift receptacle disposed in the HVACR unit, wherein the forklift receptacle comprises one or more channels configured to respectively receive one or more tines of a forklift for lifting the HVACR unit, and the forklift receptacle overlaps with a center of mass of the HVACR unit in a longitudinal direction of the HVACR unit.

Aspect 2. The HVACR unit of aspect 1, wherein a first channel of the one or more channels comprises:

a tubular body having a first end and a second end opposite to the first end relative to the tubular body;

a pocket disposed in the tubular body; and an opening disposed on the first end of the tubular body and configured to receive a first tine of the one or more tines of the forklift into the pocket.

Aspect 3. The HVACR unit of aspect 1 or 2, wherein the base comprises a unit base and a forklift base, the unit base at least partially projects into the forklift base, and the forklift receptacle is disposed in the forklift base.

Aspect 4. The HVACR unit of aspect 1 or 2, wherein the base comprises a unit base and a forklift base, the forklift receptacle is disposed in the unit support of the frame, and the unit base is attached to the unit support.

Aspect 5. The HVACR unit of aspect 3, wherein:

the unit base comprises two side members connected to two end members; and one or more support beams spanned across and attached to the two side members;

the forklift base comprises two side members connected to two end members, wherein the one or more channels is spanned across and attached to the two side members of the forklift base; and one or more cutouts is disposed on a bottom side of the two side members of the unit base, the one or more cutouts is configured to respectively fit over the one or more channels of the forklift receptacle.

Aspect 6. The HVACR unit of aspect 5, wherein the unit base comprises one or more splice plates disposed respectively over the one or more cutouts.

Aspect 7. The HVACR unit of aspect 5 or 6, wherein the forklift base comprises:

a first guide plate attached to a first side member of the two side members of the forklift base; and a second guide plate attached to a second side member of the two side members of the forklift base, wherein a distance between a top of the first guide plate and a top of the second guide plate is longer than a distance between a lower section of the first guide plate and a lower section of the second guide plate such that the unit base, being lowered from above the forklift base, is guided toward a center of the forklift base by the first guide plate or the second guide plate.

Aspect 8. The HVACR unit of any one of aspects 3-7, wherein the base comprises one or more connector plates configured to attach the unit base to the forklift base.

Aspect 9. The HVACR unit of any one of aspects 3-8, wherein the forklift base comprises one or more crane lugs disposed on the forklift base configured to receive a cable for hoisting the HVACR unit.

Aspect 10. The HVACR unit of any one of aspects 1-9, wherein a height of the HVACR unit is smaller than or equal to 2590.8 mm or 102 inches, and a width of the HVACR unit is smaller than or equal to 2590.8 mm or 102 inches.

Aspect 11. The HVACR unit of any one of aspects 1-10, wherein:

a first channel of the one or more channels is configured to receive a first tine of the one or more tines of the forklift; and a second channel of the one or more channels is configured to receive a second tine of the one or more tines the forklift, wherein the first channel and the second channel are disposed to overlap longitudinally with the center of mass of the HVACR unit.

Aspect 12. The HVACR unit of any one of aspects 1-11, wherein a distance between a center of the first channel and a center of the second channel is between 1371.6 mm and 1524 mm, or between 54 inches and 60 inches.

Aspect 13. The HVACR unit of any one of aspects 2-12, wherein the pocket is at least 127 mm, or 5 inches, tall and at least 254 mm, or 10 inches, wide.

Aspect 14. The HVACR unit of any one of aspects 1-13, further comprising a counterweight receptacle configured to receive a counterweight configured to adjust the center of mass of the HVACR unit to a center of the forklift receptacle in the longitudinal direction.

Aspect 15. A method for transporting an HVACR unit, comprising:

providing a forklift receptacle in the HVACR unit, the forklift receptacle includes one or more channels for receiving one or more tines of a forklift, and the forklift receptacle being overlapped, in a longitudinal direction of the HVACR unit, with a center of mass of the HVACR unit;

inserting the one or more tines of the forklift into the respective one or more channels of the forklift receptacle;

raising the one or more tines of the forklift to lift the HVACR unit, wherein the HVACR unit comprises: a circuit comprising a compressor, a first heat exchanger, a second heat exchanger, and an expander; and a heat exchanger assembly having a fan and one of the first heat exchanger and the second heat exchanger, the fan being configured to draw air through the heat exchanger assembly for exchanging thermal energy with a working fluid in the circuit; and loading the HVACR unit into a bed of a truck or trailer.

Aspect 16. The method for transporting the HVACR unit of aspect 15, wherein the forklift receptacle is disposed in a base of a frame of the HVACR unit; and the base comprises a unit base and a forklift base, the method further comprises lowering the unit base to be at least partially recessed in the forklift base such that: a height of the HVACR unit is smaller than or equal to 2590.8 mm or 102 inches; and the forklift receptacle is supporting a weight of the HVACR unit, through the forklift base, when the HVACR unit is lifted by the forklift receptacle.

Aspect 17. The method for transporting the HVACR unit of aspect 16, further comprising guiding the lowering of the unit base, by a first guide plate and a second guide plate disposed on the forklift base, toward a center of the forklift base.

Aspect 18. The method for transporting the HVACR unit of any one of aspects 15-17, wherein the forklift receptacle is disposed in a unit support of a frame of the HVACR unit, and the forklift receptacle is configured to vertically support a weight of the HVACR unit, through the unit support of the frame, when the HVACR unit is lifted.

Aspect 19. The method for transporting the HVACR unit of any one of aspect 15-18, the method comprising:

attaching a counterweight to a counterweight receptacle on the HVACR unit; and adjusting a weight of the counterweight so that the center of mass of the HVACR unit in a longitudinal direction is within a width of the forklift receptacle in the longitudinal direction of the HVACR unit.

Aspect 20. The method for transporting the HVACR unit of any one of aspect 15-19, further comprising unloading the HVACR unit from the bed of the flatbed truck using at the forklift receptacle.

The terminology used in this specification is intended to describe particular embodiments and is not intended to be limiting. The terms "a," "an," and "the" include the plural forms as well, unless clearly indicated otherwise. The terms "comprises" and/or "comprising," when used in this specification, specify the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. This specification and the embodiments described are exemplary only, with the true scope and spirit of the disclosure being indicated by the claims that follow.

What is claimed is:

1. A heating, ventilation, air conditioning, and refrigeration unit, comprising:

a circuit comprising a compressor, a first heat exchanger, a second heat exchanger, and an expander;

a heat exchanger assembly having a fan and one of the first heat exchanger and the second heat exchanger, the fan being configured to draw air through the heat exchanger assembly for exchanging thermal energy with a working fluid in the circuit;

a frame having a unit support disposed on a base, the unit support being configured to laterally support the heat exchanger assembly, and the base being configured to vertically support the heat exchanger assembly, a forklift receptacle disposed in the HVACR heating, ventilation, air conditioning, and refrigeration unit, wherein the base comprises a unit base and a forklift base, the unit base is at least partially recessed into the forklift base, the unit base comprises two side members connected to two end members and one or more support beams spanned across and attached to the two side members, the forklift base comprises two side members connected to two end members, wherein one or more channels is spanned across and attached to the two side members of the forklift base, the forklift receptacle is disposed in the forklift base, the forklift receptacle comprises the one or more channels, wherein one or more cutouts is disposed on a bottom side of the two side members of the unit base, the one or more cutouts is configured to respectively fit over the one or more channels of the forklift receptacle, one or more splice plates is disposed respectively over the one or more cutouts, and the forklift receptacle overlaps with a center of mass of the heating, ventilation, air conditioning, and refrigeration unit in a longitudinal direction of the heating, ventilation, air conditioning, and refrigeration unit.

2. The heating, ventilation, air conditioning, and refrigeration unit of claim 1, wherein a first channel of the one or more channels comprises:

a tubular body having a first end and a second end opposite to the first end relative to the tubular body;

a pocket disposed in the tubular body; and an opening disposed on the first end of the tubular body, wherein the pocket is at least 127 mm tall and at least 254 mm wide.

3. The heating, ventilation, air conditioning, and refrigeration unit of claim 1, wherein the forklift receptacle is disposed in the unit support of the frame, and the unit base is attached to the unit support.

4. The heating, ventilation, air conditioning, and refrigeration unit of claim 1, wherein the forklift base comprises:

a first guide plate attached to a first side member of the two side members of the forklift base; and a second guide plate attached to a second side member of the two side members of the forklift base, wherein a distance between a top of the first guide plate and a top of the second guide plate is longer than a distance between a lower section of the first guide plate and a lower section of the second guide plate such that the unit base, being lowered from above the forklift base, is guided toward a center of the forklift base by the first guide plate or the second guide plate.

5. The heating, ventilation, air conditioning, and refrigeration unit of claim 1, wherein the base comprises one or more connector plates configured to attach the unit base to the forklift base.

6. The heating, ventilation, air conditioning, and refrigeration unit of claim 1, wherein the forklift base comprises one or more crane lugs disposed on the forklift base configured to receive a cable for hoisting the HVACR unit.

7. The heating, ventilation, air conditioning, and refrigeration unit of claim 1, wherein:

a first channel of the one or more channels and a second channel of the one or more channels are disposed to overlap longitudinally with the center of mass of the heating, ventilation, air conditioning, and refrigeration unit, and a distance between a center of the first channel and a center of the second channel is between 1371.6 mm and 1524 mm.

8. A heating, ventilation, air conditioning, and refrigeration unit, comprising:

a circuit comprising a compressor, a first heat exchanger, a second heat exchanger, and an expander;

a heat exchanger assembly having a fan and one of the first heat exchanger and the second heat exchanger, the fan being configured to draw air through the heat exchanger assembly for exchanging thermal energy with a working fluid in the circuit;

a frame having a unit support disposed on a base, the unit support being configured to laterally support the heat exchanger assembly, and the base being configured to vertically support the heat exchanger assembly:

a forklift receptacle disposed in the heating, ventilation, air conditioning, and refrigeration unit, wherein the forklift receptacle comprises one or more channels, the forklift receptacle overlaps with a center of mass of the heating, ventilation, air conditioning, and refrigeration unit in a longitudinal direction of the heating, ventilation, air conditioning, and refrigeration unit; and a counterweight receptacle configured to receive a counterweight configured to adjust the center of mass of the heating, ventilation, air conditioning, and refrigeration unit to a center of the forklift receptacle in the longitudinal direction.

9. The heating, ventilation, air conditioning, and refrigeration unit of claim 8, wherein a first channel of the one or more channels comprises:

a tubular body having a first end and a second end opposite to the first end relative to the tubular body;

a pocket disposed in the tubular body; and an opening disposed on the first end of the tubular body, wherein the pocket is at least 127 mm tall and at least 254 mm wide.

10. The heating, ventilation, air conditioning, and refrigeration unit of claim 8, wherein the base comprises a unit base and a forklift base, the unit base is at least partially recessed into the forklift base, and the forklift receptacle is disposed in the forklift base.

11. The heating, ventilation, air conditioning, and refrigeration unit of claim 10, wherein the unit base comprises: two side members connected to two end members; and one or more support beams spanned across and attached to the two side members;

the forklift base comprises two side members connected to two end members, wherein the one or more channels is spanned across and attached to the two side members of the forklift base;

one or more cutouts is disposed on a bottom side of the two side members of the unit base, the one or more cutouts is configured to respectively fit over the one or more channels of the forklift receptacle; and one or more splice plates is disposed respectively over the one or more cutouts.

12. The heating, ventilation, air conditioning, and refrigeration unit of claim 11, wherein the forklift base comprises:

a first guide plate attached to a first side member of the two side members of the forklift base; and a second guide plate attached to a second side member of the two side members of the forklift base, wherein a distance between a top of the first guide plate and a top of the second guide plate is longer than a distance between a lower section of the first guide plate and a lower section of the second guide plate such that the unit base, being lowered from above the forklift base, is guided toward a center of the forklift base by the first guide plate or the second guide plate.

13. The heating, ventilation, air conditioning, and refrigeration unit of claim 10, wherein the base comprises one or more connector plates configured to attach the unit base to the forklift base.

14. The heating, ventilation, air conditioning, and refrigeration unit of claim 10, wherein the forklift base comprises one or more crane lugs disposed on the forklift base configured to receive a cable for hoisting the heating, ventilation, air conditioning, and refrigeration unit.

15. The heating, ventilation, air conditioning, and refrigeration unit of claim 8, wherein the base comprises a unit base and a forklift base, the forklift receptacle is disposed in the unit support of the frame, and the unit base is attached to the unit support.

16. The heating, ventilation, air conditioning, and refrigeration unit of claim 8, wherein:

a first channel of the one or more channels and a second channel of the one or more channels are disposed to overlap longitudinally with the center of mass of the heating, ventilation, air conditioning, and refrigeration unit, and a distance between a center of the first channel and a center of the second channel is between 1371.6 mm and 1524 mm.

* * * * *